US006536076B2

(12) United States Patent
Scian et al.

(10) Patent No.: US 6,536,076 B2
(45) Date of Patent: Mar. 25, 2003

(54) SUCTION NOZZLE FOR CLEANING APPARATUSES SUCH AS VACUUM CLEANERS, ELECTRIC BRUSHES OR SIMILAR

(75) Inventors: Luciano Scian, Cordenons (IT); Roberto Leone, Cordenons (IT); Nicola Bedeschi, Padua (IT)

(73) Assignee: Simac-Vetrella SpA, Gorgo Al Monticano (IT)

( * ) Notice: Subject to any disclaimer, the term of this patent is extended or adjusted under 35 U.S.C. 154(b) by 0 days.

(21) Appl. No.: 09/859,530

(22) Filed: May 18, 2001

(65) Prior Publication Data

US 2002/0092124 A1 Jul. 18, 2002

(30) Foreign Application Priority Data

Jan. 15, 2001 (IT) ..... UD2001A000008
Apr. 11, 2001 (IT) ..... UD2001A000069

(51) Int. Cl.[7] ..... A47L 9/02
(52) U.S. Cl. ..... 15/415.1; 15/414; 15/418
(58) Field of Search ..... 15/415.1, 418, 15/414, 416

(56) References Cited

U.S. PATENT DOCUMENTS 2,715,240 A * 8/1955 Pieper et al. ..... 15/415.1
2,815,525 A * 12/1957 Lofgren ..... 15/394
3,085,267 A * 4/1963 Jacuzzi ..... 15/1.7
3,108,311 A * 10/1963 House ..... 15/394
3,608,126 A 9/1971 Tacoma
3,942,216 A * 3/1976 Minton ..... 15/331
4,506,406 A * 3/1985 LaMonte ..... 15/398
5,502,870 A 4/1996 Ragner
5,826,301 A * 10/1998 Kang et al. ..... 15/398
2001/0042285 A1 * 11/2001 Seon et al. ..... 15/415.1

FOREIGN PATENT DOCUMENTS

| | | |
|---|---|---|
| DE | 4413071 | 10/1995 |
| EP | 0283213 | 9/1987 |
| FR | 2076110 | 10/1971 |
| WO | 8403429 | 9/1984 |

* cited by examiner

*Primary Examiner*—Chris K. Moore
(74) *Attorney, Agent, or Firm*—Antonelli, Terry, Stout & Kraus, LLP

(57) ABSTRACT

Suction nozzle (10, 110) for cleaning apparatuses such as vacuum cleaners, electric brushes or similar, comprising a central body (11, 111) provided with a suction chamber (30, 130), and at least two suction arms (12, 112) pivoting on the central body (11, 111) on opposite sides with respect to a median longitudinal axis (10*a*, 110*a*) of the central body (11, 111) itself, and each having a corresponding lower suction aperture (16, 116) with a determinate suction surface. Each suction arm (12, 112) can be directed with respect to the central body (11, 111) from an open position, of maximum transverse bulk, to at least a closed position of minimum transverse bulk. The overall suction surface, which comprises the sum of the suction surfaces of the suction arms (12, 112), remains unchanged for any position whatsoever of the suction arms (12, 112) with respect to the central body (11, 111).

19 Claims, 7 Drawing Sheets

SUCTION NOZZLE FOR CLEANING APPARATUSES SUCH AS VACUUM CLEANERS, ELECTRIC BRUSHES OR SIMILAR

FIELD OF THE INVENTION

The invention refers to a suction nozzle for cleaning apparatuses for domestic or industrial use such as vacuum cleaners, electric brushes or similar, equipped with two arms which can be directed in a plurality of positions, in order to clean efficiently even when there are obstacles or in zones which are difficult to reach, without reducing the suction surface.

BACKGROUND OF THE INVENTION

It is well-known that suction nozzles of vacuum cleaners or similar have difficulty in performing an efficient cleaning in proximity with corners or when there are obstacles such as the legs of furniture or suchlike.

The state of the art includes a suction nozzle provided with arms, or lateral fins, pivoting on the front part of the nozzle and movable between two positions, respectively open and closed, which allow the nozzle to adapt to the width of the suction area. When they are in the open position, the arms are arranged perpendicular to the longitudinal axis of the suction nozzle, determining the maximum transverse bulk thereof, and have the maximum usable suction surface pointing downwards. Vice versa, when the arms are in the closed position, parallel to the longitudinal axis of the suction nozzle, the overall bulk of the nozzle, and the usable suction surface, are reduced to a minimum. As a consequence, however, the suction capacity of the cleaning apparatus to which the nozzle is connected is also limited.

This limitation is a shortcoming which wastes time and causes a useless waste of energy on the part of the user, who is obliged to make several passes to clean a particular surface, every time the arms are in the closed position. The present Applicant has devised and embodied this invention to overcome this shortcoming and to obtain further advantages.

SUMMARY OF THE INVENTION

The invention is set forth and characterized essentially in the main claim, while the dependent claims describe other innovative characteristics of the invention.

One purpose of the invention is to achieve a suction nozzle for cleaning apparatuses such as vacuum cleaners or similar, of the type comprising suction arms, which will allow an efficient cleaning in proximity with corners, narrow parts or obstacles and which will not modify the suction capacity when it changes configuration.

Another purpose of the invention is to achieve a suction nozzle which will be easy to use and economic to make.

In accordance with these purposes, the suction nozzle according to the invention comprises a central body able to be connected with a cleaning apparatus, and on which at least two suction arms pivot on opposite sides with respect to a median longitudinal axis. The at least two suction arms can be selectively directed from a open position of maximum transverse bulk to at least a closed position of minimum transverse bulk. The central body comprises at least a suction chamber and each suction arm is provided with a lower suction aperture which defines a relative suction surface.

According to one characteristic of the invention, the sum of the suction surfaces of the two suction arms remains unchanged for whatever position the latter have with respect to the central body.

Each lower suction aperture is in constant communication with the suction chamber of the central body, both in the open position and in the closed position, and in any other intermediate position of the corresponding suction arm.

Moreover, in accordance with a first embodiment, each suction arm can be temporarily kept in the closed position, or in an intermediate position, by corresponding clamping means, while release means are provided to automatically return the suction arm to the open position.

A further advantage of the nozzle according to the invention is that the two suction arms, together with the lower part of the central body, define a very large supporting base for the cleaning apparatus, which can thus remain vertical, autonomously, without needing to be rested on a vertical wall.

In a preferential embodiment, the clamping means each comprise a lever having a hook able to engage with a mating plurality of teeth, movable together with the corresponding suction arm. The release means comprise a pedal attached to the free end of the clamping lever and able to selectively dis-associate the afore-said hook from the teeth, and elastic means able to keep the corresponding suction arm normally in the open position.

In accordance with a second embodiment, the suction chamber is substantially annular in shape and is in communication not only with the two lateral suction arms, but also with at least an additional suction aperture, made on the lower surface of the central body. Advantageously there are two additional apertures, one arranged at the front and one at the rear with respect to the suction arms, and both lying on the median longitudinal axis of the suction nozzle.

In this second embodiment, each suction arm can perform a rotation of about 80°, both in one direction and the other, with respect to the open position, of maximum bulk, and elastic means are provided to automatically return each suction arm to the open position.

BRIEF DESCRIPTION OF THE DRAWINGS

These and other characteristics of the invention will be clear from the following description of some preferential forms of embodiment, given as a non-restrictive example, with reference to the attached drawings wherein.

DETAILED DESCRIPTION OF TWO PREFERENTIAL FORMS OF EMBODIMENT

Figure 1:
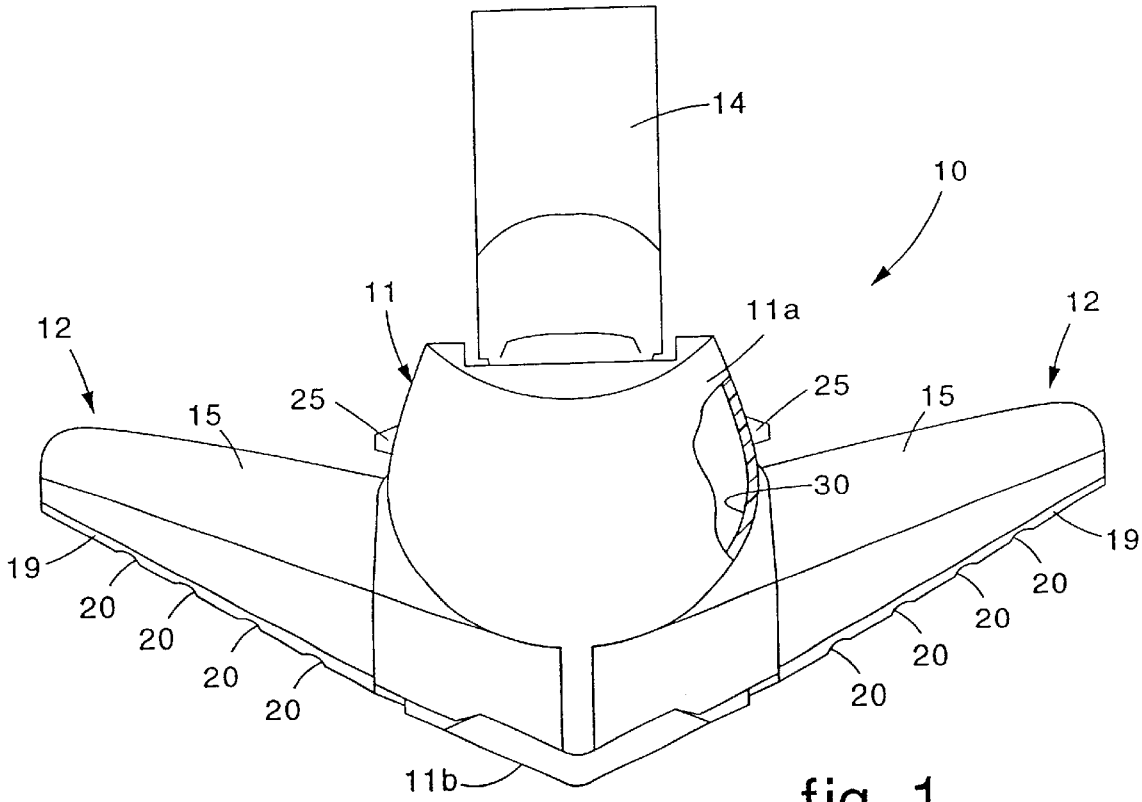
FIG. 1 is a three-dimensional view of a suction nozzle according to the invention in a first embodiment, wherein the suction arms are in a completely open position.
Figure 2:
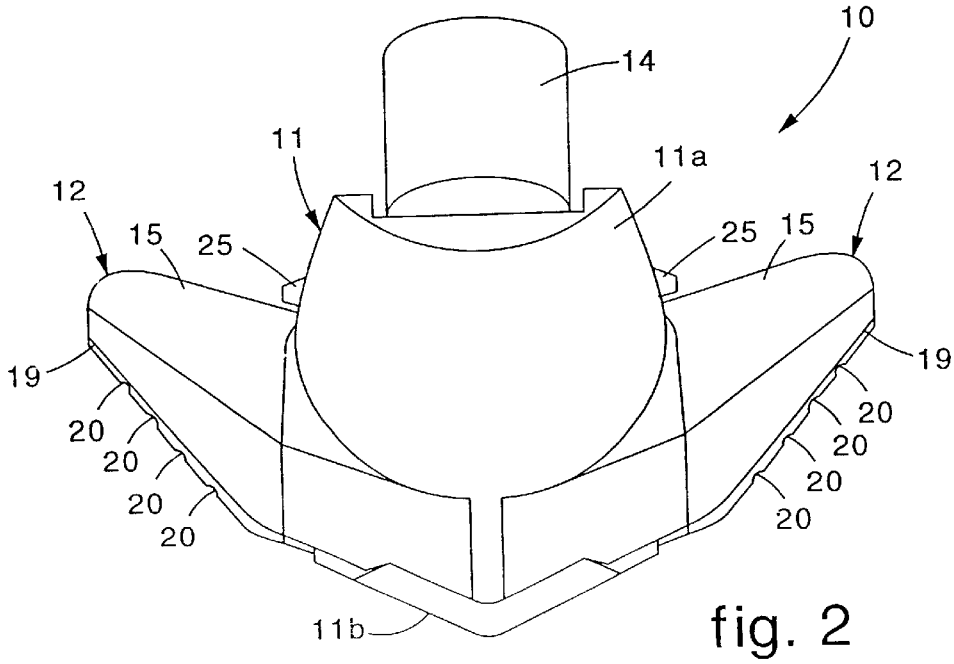
FIG. 2 shows the nozzle in FIG. 1 in a completely closed position.
Figure 3:
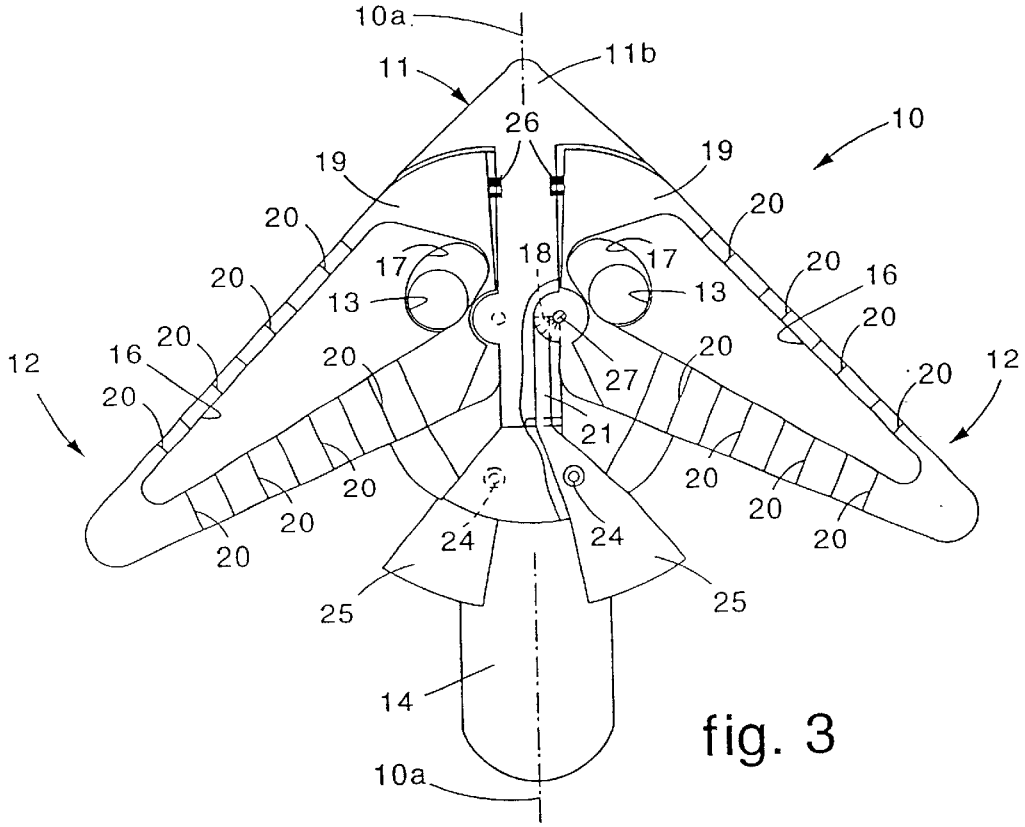
FIG. 3 is a view from below, partly in section, of the nozzle in FIG. 1.
Figure 4:
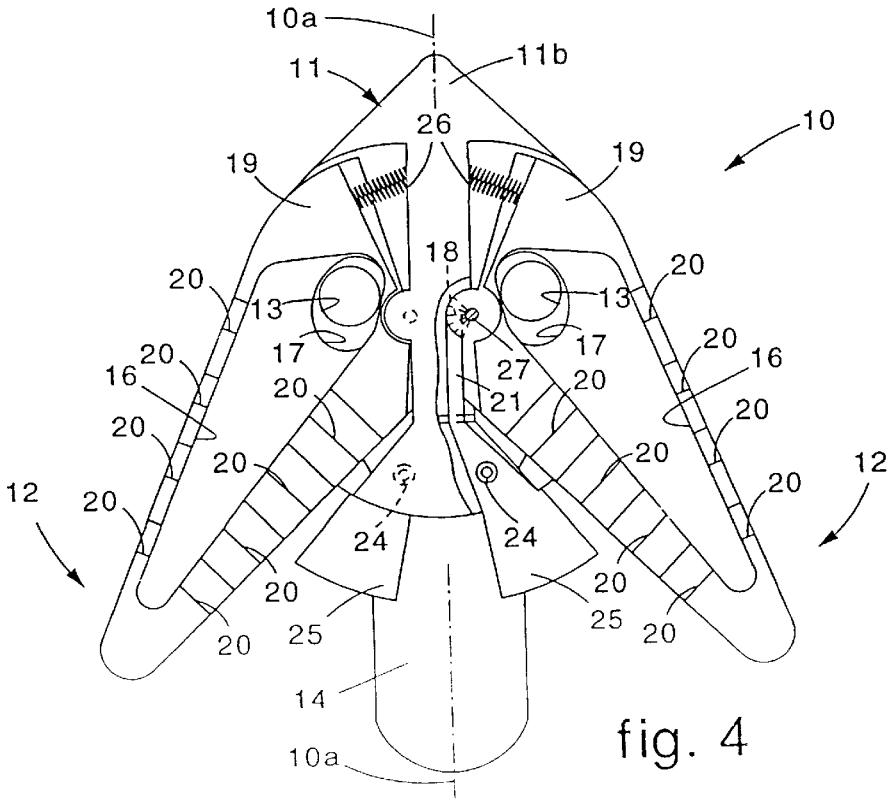
FIG. 4. is a view from below, partly in section, of the nozzle in FIG. 2.
Figure 5A:
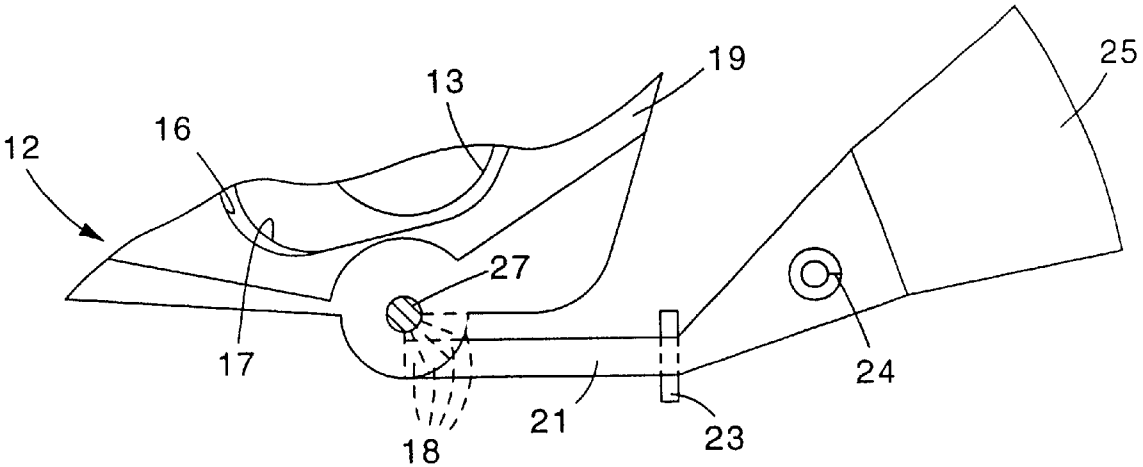
FIG. 5*a* is an enlarged detail of FIG. 3.
Figure 5B:
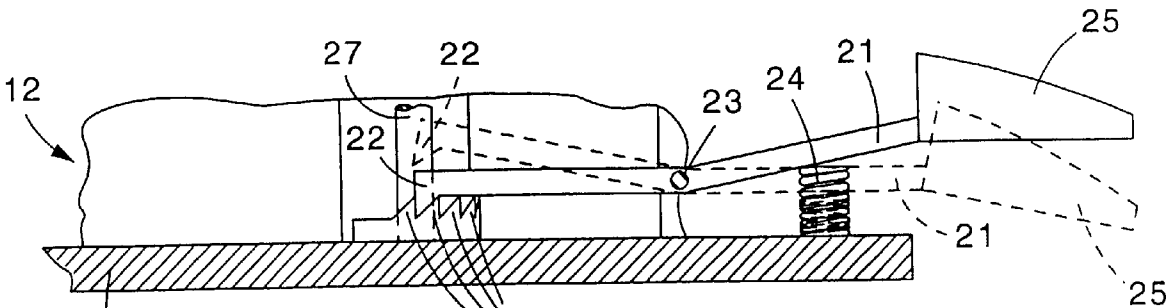
FIG. 5*b* is a side view of the detail in FIG. 5*a;*

With reference to FIGS. 1 to 5*b,* in a first form of embodiment, a suction nozzle 10 according to the invention comprises a central body or shell 11 on which two suction arms or lateral fins 12 pivot by means of pins 27 (FIG. 3); the fins 12 are arranged on opposite sides with respect to a median longitudinal axis 10*a* of the central body 11. Each fin 12 is selectively movable from an open position (FIGS. 1 and 3) wherein they define the maximum transverse bulk of the nozzle 10, to a substantially closed position (FIGS. 2 and 4) wherein the nozzle 10 has its minimum transverse bulk.

The shell 11 comprises a rounded upper part 11*a* which defines a suction chamber 30, and a flat lower surface 11*b,* with the front part pointed, which together with the fins 12 confers on the nozzle 10 a substantially arrow-like shape.

A tubular element 14, able to be connected to a cleaning apparatus of a conventional type and not shown in the drawings, is jointed in the upper part 11*a* of the shell 11 and ends in the suction chamber 30 thereof.

In the lower surface 11*b* there are two apertures 13 arranged in a substantially central position and communicating with the suction chamber 30.

Each fin 12 is shaped so as to define a wall 15 with a cross section shaped substantially like an upside down U and provided with a lower suction aperture 16. There is an eyelet 17 provided on the wall 15 able to connect the apertures 13 with the lower suction apertures 16, so that for any position of the fins 12 the lower suction apertures 16 are always in communication with the apertures 13 and hence with the suction chamber 30. In this way, moreover, the suction surface of the nozzle 10, given by the two lower suction apertures 16, remains unchanged for whatsoever position of the fins 12.

Each fin 12 also comprises a flat surface 19 able, during use, to be in contact with the floor or other surface to be cleaned. The flat surface 19 is arranged on the perimeter with respect to the corresponding lower suction aperture 16 and comprises a plurality of grooves 20 able to facilitate the channeling of the dirt sucked in towards the lower aperture 16.

Around each pin 27 a plurality of teeth 18 are positioned, able to define the number of intermediate positions which the fins 12 can assume between the open position and the closed position.

For every fin 12 the nozzle 10 also comprises a lever 21 pivoting on a pin 23 of the shell 11 and provided with a hook 22 able to engage with the teeth 18.

Each lever 21 cooperates with a spring 24 able to keep the respective tooth 22 normally engaged with the teeth 18. At one end of every lever 21 a pedal 25 is attached, which protrudes from the shell 11 and allows the user to selectively disengage the hook 22 from the teeth 18.

A pair of second springs 26 is provided to keep each fin 12 normally connected to the shell 11 and in the open position.

The nozzle 10 as described heretofore functions as follows.

The fins 12 are normally in the open position, held by the springs 26.

Every time, during use, that the nozzle 10 meets an obstacle or a very narrow passage, one or both fins 12 rotate on the pills 27 until they reach the necessary angle so that the nozzle 10 can pass the obstacle or through the narrow passage. During this rotation, the teeth 18 of each fin 12, rotating with the fin 12, cause the corresponding hook 22 of the lever 21 to be raised. When the fins 12 have reached the position which allows them to pass the obstacle, the hooks 22, by means of the action of the springs 24, clamp the fins 12 in said position.

During this operation the overall suction surface of the nozzle 10 remains unchanged since the eyelets 17 ensure that the apertures 13 are in constant communication with the lower suction apertures 16, thus ensuring the same initial suction surface.

When it is desired to return one or both fins 12 to their initial open position, it is necessary to act on the corresponding pedal 25, lifting the hook 22 and thus allowing the second spring 26 to return the fin 12 automatically to the initial position.

Figure 6:
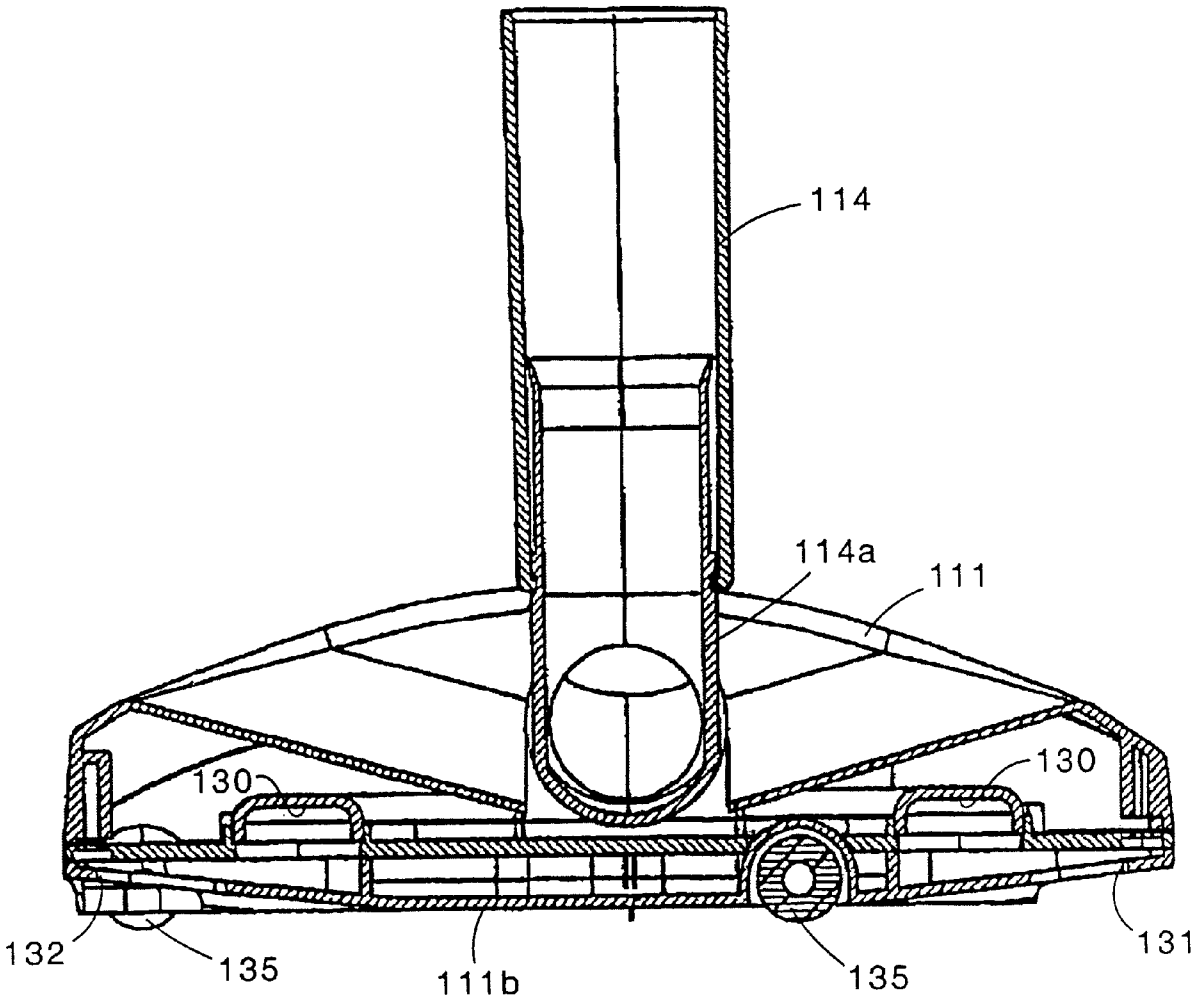
FIG. 6 is a longitudinal section of a suction nozzle in a second embodiment.
Figure 7:
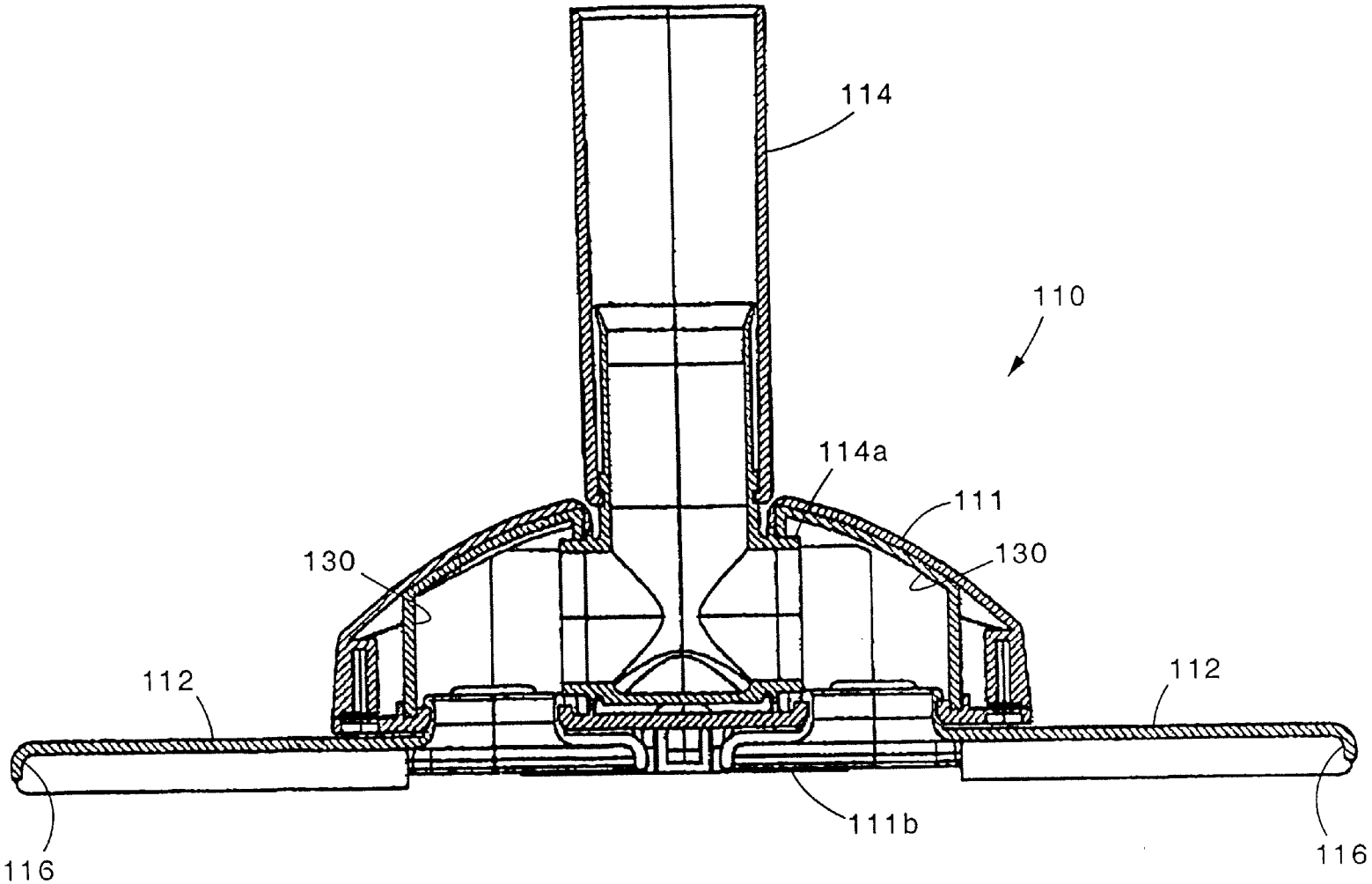
FIG. 7 is a cross section of the suction nozzle in FIG. 6.
Figure 8:
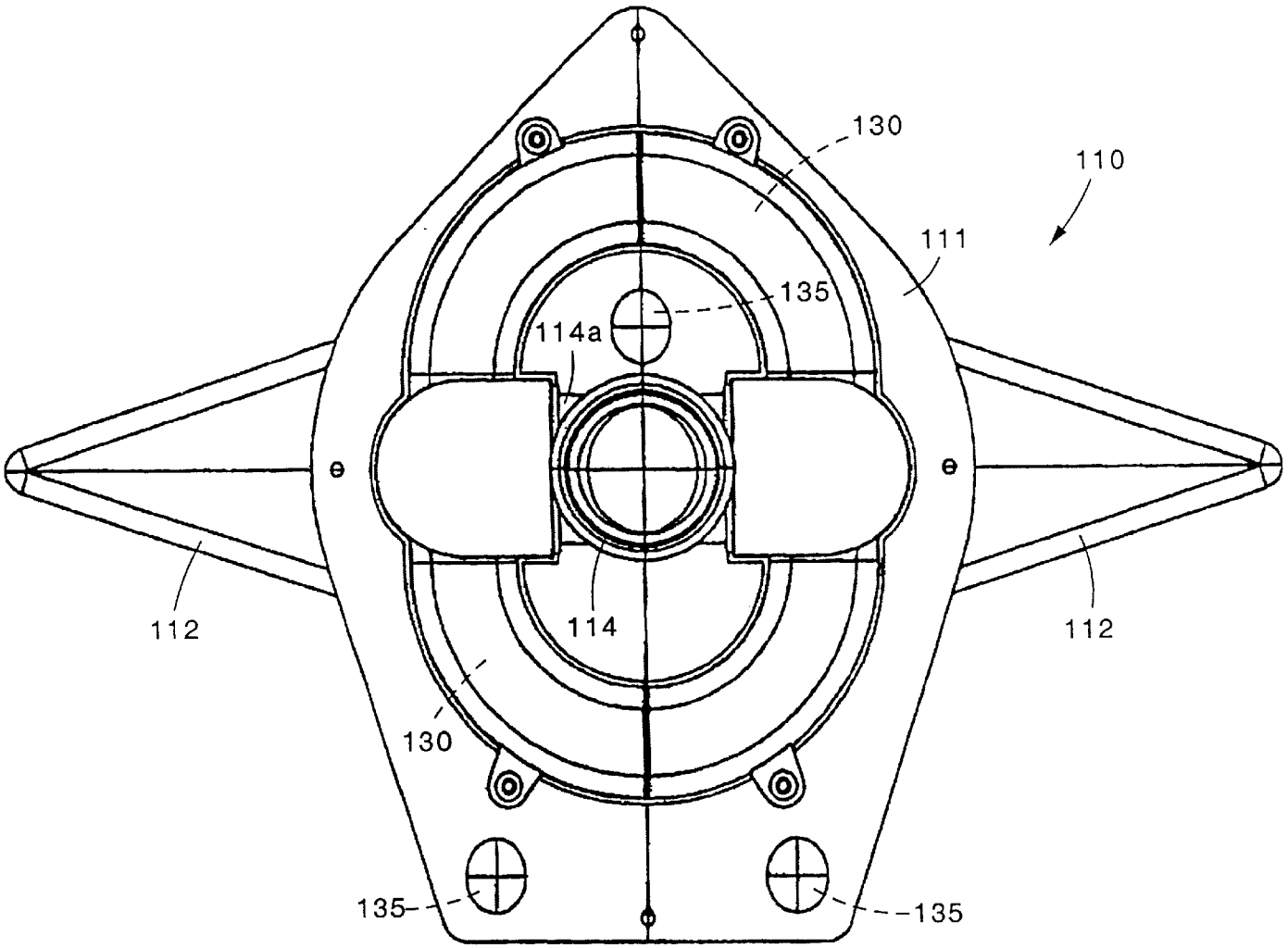
FIG. 8 is a view from above of the suction nozzle in FIG. 6.
Figure 9:
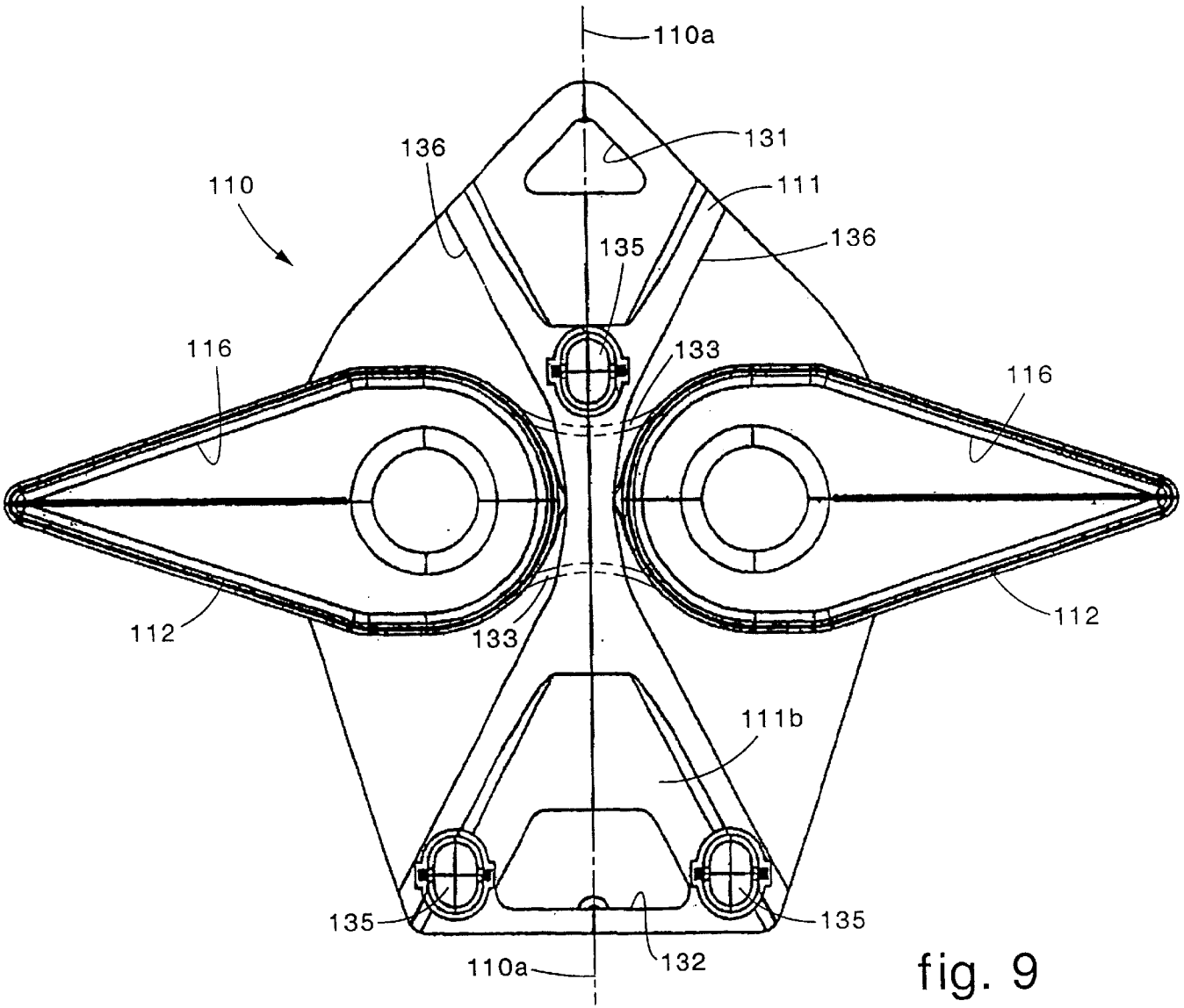
FIG. 9 is a view from below of the suction nozzle in FIG. 6.

With reference to FIGS. 6 to 9, in a second embodiment, a suction nozzle 110 according to the invention comprises a central body 111 on which, in a substantially central zone, two suction arms 112 pivot, with a pointed shape and having lower suction apertures 116. In the central body 111 there is a suction chamber 130, substantially annular in shape, which is in communication at the upper part with a tubular element 114 having its jointed terminal part 114*a* shaped like an upside down T and which, at the lower part, is in communication not only with the two suction arms 112 but also with two additional suction apertures 131 and 132, made on the lower surface 111*b* of the central body 111.

The two additional apertures 131 and 132 are arranged one at the front and one at the rear with respect to the suction arms 112, and both lie on the median longitudinal axis 110*a* of the suction nozzle 110.

In this second embodiment, each suction arm 112 is housed in a corresponding lower niche 136 of the central body 111 and pivots so as to be able to perform a rotation of about 80°, in both one direction and the other, with respect to the open position of maximum bulk. Two foil-type springs 133 (FIG. 9) are arranged in contact with the two suction arms 112 to return the latter automatically to the open position after they have momentarily folded, for any reason whatsoever, for example because of an obstacle, towards the longitudinal axis 110*a*.

Three lower wheels 135 are positioned, one in the front part and two in the rear part of the nozzle 110, to allow the latter to move parallel to the surface to be cleaned, without the suction arms 112 sliding on the surface itself.

It is clear that modifications and/or additions can be made to the suction nozzles 10, 110 as described heretofore, without departing from the spirit and scope of the invention. For example, brushes, bristles, or other similar cleaning elements can be arranged in the lower surface 11*b,* 111*b* of the nozzles 10, 110, advantageously in the rear part thereof, so as to improve the removal of dirt.

It is also obvious that, although the invention has been described with reference to two specific examples, a person of skill in the art shall certainly be able to achieve many other equivalent forms of suction nozzles for cleaning apparatuses, all of which shall come within the field and scope of the invention.

What is claimed is:

1. Suction nozzle for cleaning apparatuses, comprising a central body provided with a suction chamber and able to be connected to said cleaning apparatuses, and at least two suction arms pivoting on said central body on opposite sides with respect to a median longitudinal axis of said central body, each of said suction arms having a corresponding lower suction aperture with a predetermined suction surface area, each of said suction arms movable with respect to said central body from an open position, of maximum transverse bulk, to at least a closed position of minimum transverse bulk, wherein a sum of the suction surface areas of said suction arms, remains unchanged for any position whatsoever of said suction arms with respect to said central body.

2. Suction nozzle as in claim 1, further comprising temporary clamping means for temporarily clamping said suction arms in a plurality of intermediate positions between said open position and said closed position, and release means for automatically returning said suction arms to said open position.

3. Suction nozzle as in claim 2, wherein said temporary clamping means each comprise a lever provided with a hook able to engage with a mating plurality of teeth of said suction arms.

4. Suction nozzle as in claim 3, wherein said lever pivots on a pin of said central body.

5. Suction nozzle as in claim 3, further comprising first elastic means for keeping said hook normally engaged with said plurality of teeth.

6. Suction nozzle as in claim 5, wherein said first elastic means comprise a first spring arranged between said lever and said central body.

7. Suction nozzle as in claim 3, wherein said teeth are provided in a number equal to a number of angular positions which can be assumed by each of said suction arms.

8. Suction nozzle as in claim 3, wherein said release means comprise a pedal attached to a free end of said lever and second elastic means able to keep each of said suction arms normally in said open position.

9. Suction nozzle as in claim 8, wherein said second elastic means comprise at least a second spring connected to said central body and to the corresponding of said suction arms.

10. Suction nozzle as in claim 8, wherein said pedal protrudes from a rear of said central body.

11. Suction nozzle as in claim 1, wherein each of said suction arms comprises at least an eyelet to maintain said suction chamber constantly in communication with the corresponding lower apertures.

12. Suction nozzle as in claim 1, wherein said suction arms are provided with lower grooves able to channel the dirt towards said lower suction apertures.

13. Suction nozzle as in claim 1, wherein said suction chamber is substantially annular in shape and is in communication at an upper part of the suction chamber with a tubular element having it's a jointed terminal part shaped like an upside down T and, at a lower part of the suction chamber, is in communication with said two suction arms and with at least an additional suction aperture provided on a lower surface of said central body.

14. Suction nozzle as in claim 1, further comprising two additional apertures arranged one in front and one behind said suction arms, wherein said two additional apertures lie on said median longitudinal axis of said central body.

15. Suction nozzle as in claim 13, wherein each of said suction arms is housed in a corresponding lower niche of said central body and pivots on said central body so as to be able to mark a rotation of about 80°, both in one direction and the other, with respect to said open position.

16. Suction nozzle as in claim 13, further comprising two foil-type springs arranged in contact with said suction arms to return the latter automatically to said open position.

17. Suction nozzle as in claim 13, further comprising a plurality of lower wheels positioned in the lower part of said central body to allow said central body to move parallel to a surface to be cleaned without said suction arms sliding on said surface.

18. Suction nozzle as in claim 17, wherein said plurality of lower wheels comprise three lower wheels one of said three lower wheels being arranged in front of said suction arms and two, of said three lower wheels being arranged behind said suction arms.

19. Suction nozzle as in claim 1, further comprising brushes provided on a lower surface of said suction nozzle to facilitate removal of dirt from a surface to be cleaned.

* * * * *